US007911404B2

(12) United States Patent
Yamagajo et al.

(10) Patent No.: US 7,911,404 B2
(45) Date of Patent: Mar. 22, 2011

(54) RF TAG AND METHOD OF PRODUCING RF TAG

(75) Inventors: Takashi Yamagajo, Kawasaki (JP); Toru Maniwa, Kawasaki (JP); Manabu Kai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 454 days.

(21) Appl. No.: 12/071,039

(22) Filed: Feb. 14, 2008

(65) Prior Publication Data

US 2008/0150726 A1 Jun. 26, 2008

Related U.S. Application Data

(63) Continuation of application No. PCT/JP2005/016140, filed on Sep. 2, 2005.

(51) Int. Cl.
*H01Q 9/28* (2006.01)

(52) U.S. Cl. ..... 343/795; 343/700 MS

(58) Field of Classification Search ..... 343/803, 343/804, 700 MS, 702, 795
See application file for complete search history.

(56) References Cited

U.S. PATENT DOCUMENTS

| | | | | |
|---|---|---|---|---|
| 6,100,804 | A * | 8/2000 | Brady et al. | 340/572.7 |
| 7,055,754 | B2 * | 6/2006 | Forster | 235/492 |
| 7,345,575 | B2 * | 3/2008 | Tuttle et al. | 340/10.1 |
| 7,546,671 | B2 * | 6/2009 | Finn | 29/592.1 |
| 2003/0103015 | A1 | 6/2003 | Oh | |
| 2005/0024287 | A1 | 2/2005 | Jo et al. | |

FOREIGN PATENT DOCUMENTS

| | | |
|---|---|---|
| EP | 1555715 | 7/2005 |
| JP | 49-55259 | 5/1974 |
| JP | 58-099006 | 6/1983 |
| JP | 61-218206 | 9/1986 |
| JP | 2-9481 | 3/1990 |
| JP | 3-27121 | 4/1991 |
| JP | 03-126302 | 5/1991 |
| JP | 09-199931 | 7/1997 |
| JP | 2002-198723 | 7/2002 |
| JP | 2002366917 | 12/2002 |
| JP | 2003-174317 | 6/2003 |
| JP | 2004-207929 | 7/2004 |
| JP | 2005-165462 | 6/2005 |
| JP | 2005-203878 | 7/2005 |
| WO | 2004093249 | 10/2004 |

OTHER PUBLICATIONS

EP Search Report issued in 05781406 dated Oct. 23, 2008.
Hayashida S. et al: "Characteristics of Built-in Folded Monopole Antenna for Handsets" IEICE Transactions on Communications, Communications Society, Tokyo, Japan vol. E88-B, No. 6, Jun. 1, 2005, pp. 2275-2283, XP001230777.

(Continued)

*Primary Examiner* — HoangAnh T Le
(74) *Attorney, Agent, or Firm* — Murphy & King, PC

(57) ABSTRACT

An RF tag includes a first transmission line which is connected to a grounding conductor and forms an electric closed loop to constitute a dipole antenna. A power supply circuit is connected between a branch point on the first transmission line and the grounding conductor. A second transmission line is connected to the branch point and arranged in parallel with the power supply circuit to constitute an inductor.

8 Claims, 17 Drawing Sheets

OTHER PUBLICATIONS

Niu F Ed- Institute of Electrical and Electronics Engineers: "Folded L-Antennas" IEEE Antennas and Propagation Society International Symposium. 2000 Digest. APS. Salt Lake City, UT, Jul. 16-21, 2000; [IEEE Antennas and Propagation Society International Symposium], New York, NY: IEEE, US, Jul. 16, 2000, pp. 1666-1669, XP000993904.

The Institute of Electronics, Information and Communication Engineers, Antenna Kogaku Handbook, First edition, Dai 10 Satsu, Ohmsha, Ltd., 1999, ISBM4-274-02677-9, pp. 112 to 116.

http;//www.awid.com/product/mt__tag/mt.htm, Jun. 9, 2004.

Taiwanese Search Report based on Taiwanese Application No. 094130120.

* cited by examiner

RF TAG AND METHOD OF PRODUCING RF TAG

CROSS-REFERENCE TO RELATED APPLICATION

This application is a U.S. continuation application which is filed under 35 U.S.C. 111(a) and claims the benefit under 35 U.S.C. 120 and 365(c) of International Application No. PCT/JP2005/016140, filed on Sep. 2, 2005, the contents of which are incorporated herein by reference in their entirety.

BACKGROUND OF THE INVENTION

1. Field of the Invention

This invention relates to an RF tag and a method of producing an RF tag.

2. Description of the Related Art

In order to manage various goods, products, and other objects, RF tags are often used. This system includes a variety of RF tags and a reader/writer device (called RF tag reader) which reads information from each RF tag or writes information to each RF tag. An RF tag is accompanied with each of the respective objects. The RF tag reader may also be referred to as an interrogator. The RF tag may also be referred to as an RFID tag, a radio tag, an IC tag, etc. In an RF tag, an identification information (ID), a serial number, a date of production, a place of production, and other data may be additionally recorded.

Generally, RF tags are classified into an active model and a passive model. The active model RF tag is provided to generate electric power by itself, which makes it possible to simplify the layout and configuration of an RF tag reader. The passive model RF tag is provided so that it does not generate electric power by itself. The passive model RF tag receives energy supplied from the exterior so that it operates to transmit ID information and so on. Use of the passive model RF tag is desirable from the viewpoint of making RF tags inexpensive and will be promising in the future.

From the viewpoint of the frequency band of a transmission signal used, RF tags may be classified into an electromagnetic coupling type and an electromagnetic wave type. The RF tags of the former type use frequency bands ranging from several kilohertz to about 13 megahertz. The RF tags of the latter use UHF bands (for example, 950 MHz) and high frequency bands (for example, 2.45 GHz).

It is desirable to use a transmission signal with a high frequency from the viewpoint of increasing a distance that can be communicated and from the viewpoint of making RF tags small in size. As an example, it is known that the distance that can be communicated for an electromagnetic coupling type RF tag is at most about 1 meter. If the signal frequency is about 950 MHz, the corresponding wavelength is about 30 cm. However, if the signal frequency is about 13 MHz, the corresponding wavelength is about 23 m.

There are various objects that are considered as an object with which an RF tag can be accompanied. In particular, whether the object which an RF tag is accompanied with has conductivity is important in designing an RF tag. If the object is an insulation, the operating characteristics of an RF tag remain almost unchanged before and after the RF tag is attached to the object.

However, if an RF tag is attached to a conductive material, such as a metal housing, the image current by the conductive material occurs at the time of communication of the RF tag.

Therefore, the operating characteristics of the RF tag differ greatly before and after the RF tag is attached to the object of a conductive material.

For the product uses in which the object with which an RF tag is accompanied is relatively small in size, or for the product uses in which the appearance of the object is most important (for example, a speedometer of a large-sized motorbike, a flower vase exhibited in a show window, etc.), it might be necessary to accommodate an RF tag in the object. In such a case, if the object in which the RF tag is accommodated can penetrate electromagnetic waves (UHF band), performing wireless communications with the RF tag is possible. However, also in this case, the operating characteristics of the RF tag vary greatly depending on whether a metal surface exists in the vicinity of the RF tag accommodated.

The non-patent document (from http://www.awid.com/product/mt_tag/mt.htm available at the time of filing of the present application) discloses a conventional RF tag which is capable of being attached to a metal. The RF tag as disclosed in the non-patent document has the antenna structure which is designed to operate as a dipole antenna having a length larger than half the wavelength. Specifically, in this RF tag, a conductive material which provides a pattern of an antenna is provided on the front surface of a dielectric material, a metal layer is formed on the bottom surface of the dielectric material, and the overall length of the RF tag is equal to about ½ wavelength.

Since the operating frequency is in a range of 902 to 928 MHz, the overall length of the RF tag is set to about 17 cm. However, this RF tag is too large in size, and there is a problem that the kind of the objects to which the RF tag can be attached is restricted.

SUMMARY OF THE INVENTION

According to one aspect of the invention, there is disclosed an improved RF tag in which the above-described problems are eliminated.

According to one aspect of the invention, there are disclosed an RF tag which can be accommodated in a small housing having a metal surface, and a method of producing the RF tag.

In an embodiment of the invention which solves or reduces one or more of the above-mentioned problems, there is disclosed an RF tag comprising: a first transmission line connected to a grounding conductor to form an electric closed loop, so that a dipole antenna is constituted; a power supply circuit connected between a branch point on the first transmission line and the grounding conductor; and a second transmission line connected to the branch point and arranged in parallel with the power supply circuit, so that an inductor is constituted.

According to the RF tag in an embodiment of the invention, it is possible to accommodate the RF tag in a small housing having a metal surface.

DETAILED DESCRIPTION OF THE PREFERRED EMBODIMENTS

Figure 1:
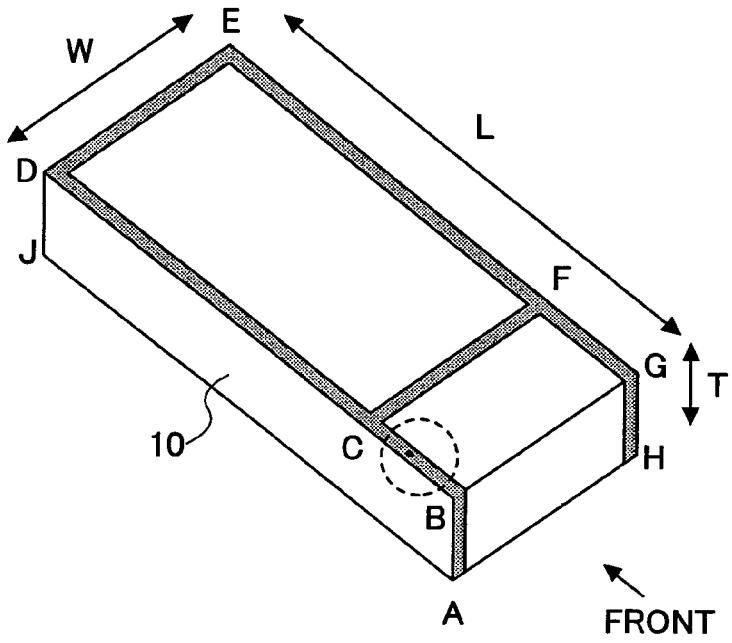
FIG. 1 is a perspective view of an RF tag in an embodiment of the invention.

An RF tag in an embodiment of the invention includes a first transmission line which is provided to constitute a dipole antenna, and a second transmission line which is provided to constitute an inductor and arranged in parallel with a power supply circuit provided on the first transmission line. The first transmission line is connected to a grounding conductor and an image current is used at the time of operation of the RF tag. The matching in impedance of the antenna and the power supply circuit may be attained by adjusting inductance. Accordingly, it is possible to provide a very small RF tag which may be accompanied with an object having a metal surface.

The above-mentioned RF tag may be configured so that the second transmission line includes a transmission line element which connects two branch points on the first transmission line. A part of the transmission line of the dipole antenna and a part of the transmission line of the inductor are arranged in common, and it is possible to make the size of the entire RF tag small.

The above-mentioned RF tag may be configured so that a position of the branch point of the first transmission line and the second transmission line is adjusted so that an impedance of the dipole antenna matches with an impedance of the power supply circuit.

The above-mentioned RF tag may be configured so that the first and second transmission lines are arranged on a spacer of a material having a predetermined dielectric constant. From the theoretical viewpoint, an air space may be provided between the first and second transmission lines and the grounding conductor. However, from the practical viewpoint of securing the rigidity of an RF tag, it is desirable to arrange the spacer between the first and second transmission lines and the grounding conductor.

The above-mentioned RF tag may be configured so that the first and second transmission lines are arranged to have a form along sides of a rectangular parallelepiped. In this case, the size of the RF tag is made equal to the size of the rectangular parallelepiped.

The above-mentioned RF tag may be configured so that the first and second transmission lines are arranged so that an image current flowing through the first and second transmission lines flows through the grounding conductor. In this case, the size of the dipole antenna can be made small.

The above-mentioned RF tag may be configured so that the first transmission line includes a first pair of parallel transmission line elements connected to the grounding conductor, and the second transmission lines includes a second pair of parallel transmission line elements perpendicularly intersecting the first pair of parallel transmission line elements. In this case, the pattern of transmission lines is simplified, and it is possible to not only raise the yield but also prevent effectively unnecessary reflection of a signal flowing through the transmission lines.

The above-mentioned RF tag may be configured so that a line element length of a second pair of transmission line elements included in the second transmission line is smaller than twice a line element length of a first pair of transmission line elements included in the first transmission line. In this case, it is possible to ensure that the antenna formed on the first transmission line operates as a dipole antenna instead of operating as a loop antenna.

The above-mentioned RF tag may be configured so that the grounding conductor is connected to a metal surface of an object with which the RF tag is accompanied. In this case, the grounding potential is supplied to the RF tag stably, and the characteristics (antenna gain, etc.) of the RF tag can be improved.

The above-mentioned RF tag may be configured so that the first and second transmission lines are formed by microstrip lines.

A method of producing an RF tag in an embodiment of the invention includes: forming a conductive layer with first and second window frames being formed adjacent to each other, on a flexible film; bending the flexible film so that a portion of the conductive layer where the first window frame is formed and a portion of the conductive layer where no window frame is formed face each other; and sticking the flexible film on a spacer of an insulating material. Accordingly, it is possible to simply manufacture a small RF tag which is accompanied with an object having a metal surface.

In a method of producing an RF tag in an embodiment of the invention, the RF tag includes a first transmission line constituting a dipole antenna and a second transmission line constituting an inductor which are formed on a front surface of a spacer of an insulating material, and a grounding conductor on a bottom surface of the spacer which is electrically connected to the first and second transmission lines, the method including: providing a power supply circuit between a branch point on the first transmission line and the grounding conductor; and connecting the second transmission line to a branch point on the first transmission line so that the second transmission line is arranged in parallel with the power supply circuit. Accordingly, it is possible to simply manufacture a small RF tag which is accompanied with an object having a metal surface, by using the existing method of producing microstrip lines.

A description will be given of embodiments of the invention with reference to the accompanying drawings.

Figure 2:
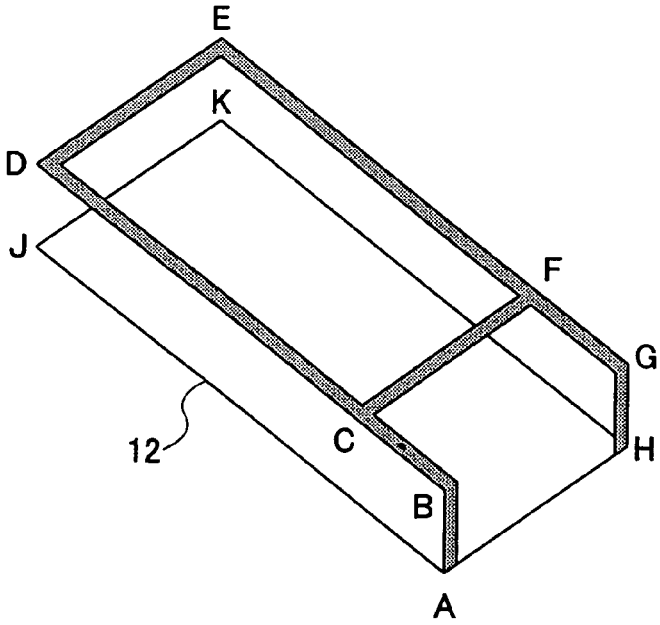
FIG. 2 is a diagram showing the positional relationship between conductive transmission lines and a grounding conductor.

FIG. 1 is a perspective view of an RF tag in an embodiment of the invention. This RF tag includes a spacer 10, a plurality of conductive line elements disposed on the front and top surfaces of the spacer 10, a power supply circuit disposed on the line element (as indicated by the dotted line between the points B and C in FIG. 1), and a grounding conductor 12 (see FIG. 2) disposed on the bottom surface of the spacer 10. FIG. 2 shows the positional relationship between the conductive transmission lines and the grounding conductor.

The spacer 10 has a predetermined relative permittivity which is equal to, for example, 2.6. The spacer 10 is arranged in a form of a rectangular parallelepiped which has a predetermined length L (for example, 31 mm), a predetermined width W (for example, 13 mm), and a predetermined thickness T (for example, 6 mm). These numerical values are given as an example, and any other numerical values may be used. Generally, according to the invention, it is permitted that the length L is smaller than half the wavelength (UHF band) of a transmission signal used.

The plurality of conductive line elements are arranged on the front and top surfaces of the spacer 10. As illustrated, the conductive line elements are arranged to have a form along the sides of the rectangular parallelepiped. The line elements are used to represent all or a part of a transmission line. A first transmission line, passing the respective points A, B, C, D, E, F, G and H and connected to the grounding conductor 12, forms a first closed loop to constitute a dipole antenna. An integrated circuit IC (called the power supply circuit) is provided to perform storing and processing of information and transmitting/receiving of an electric wave, and this integrated circuit is disposed on a conductive line element BC between the points B and C.

Two branch points C and F are provided on the first closed loop, and a conductive line element CF is disposed to connect the branch points C and F together. A second transmission line, passing the respective points C, F, G, H and A and containing the conductive line element CF, is electrically connected in parallel with the power supply circuit to constitute an inductor.

Next, the operation of the RF tag according to the invention will be explained.

As shown in FIG. 2, the transmission lines on the front surface of the spacer 10 are electrically connected to the grounding conductor 12 on the bottom surface of the spacer 10. Therefore, an image current flows through the grounding conductor 12 at the time of operation of the RF tag, and the transmission lines shown in FIG. 2 can be considered equivalent to the transmission lines shown in FIG. 3.

Figure 3:
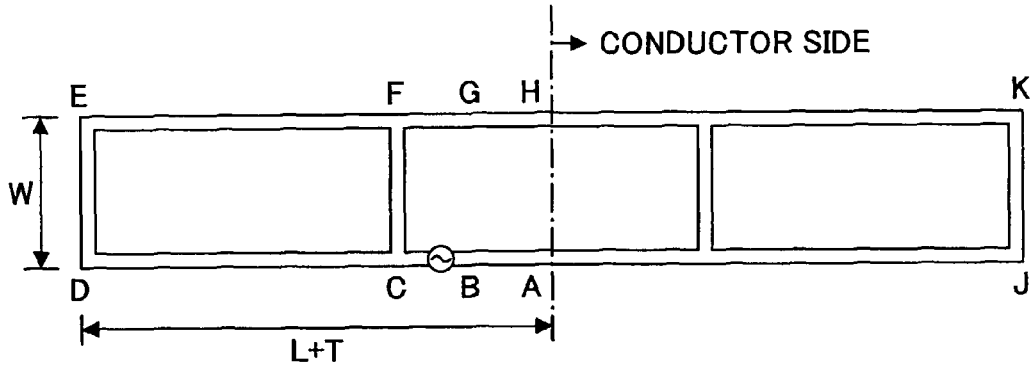
FIG. 3 is a diagram for explaining operation of the RF tag.
Figure 4:
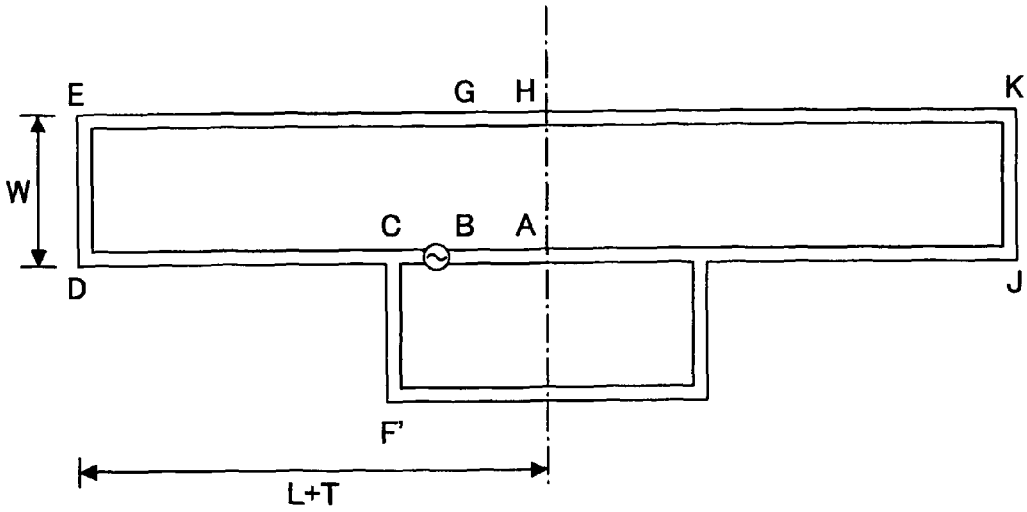
FIG. 4 is a diagram for explaining operation of the RF tag.

Furthermore, if the transmission lines shown in FIG. 3 are divided into the inductor containing the line element CF and the portion constituting the dipole antenna, the transmission lines shown in FIG. 3 can be considered equivalent to the transmission lines shown in FIG. 4.

As shown in FIG. 4, the RF tag include a folded-dipole antenna which passes the points A, B, C, D, E, G, H, K, J and A, and an inductor which is formed with the transmission line CF' (arranged in parallel with the power supply circuit).

As is apparent from the simulation results (which will be mentioned later), the inductance of the inductor is adjusted by changing a position of the point C on the line element BD (or a position of the point F on the line element GE indicated in FIG. 3). By adjusting this inductance appropriately, the impedance of the dipole antenna and the impedance of the power supply circuit can be matched appropriately.

Among the line elements shown in FIG. 1 and FIG. 2, the portions of the line element AB and the line element GH directly contribute to radiation of electromagnetic waves. Accordingly, the larger the thickness T of the spacer 10, the better the performance of the tag antenna, such as antenna gain.

As mentioned above, the line element lengths W, L and T may take various numeral values. However, in order to ensure that the antenna functions as a dipole antenna, it is necessary that the line element lengths W, L and T satisfy the condition: $W<2(L+T)$.

If $W=2(L+T)$, the corresponding antenna is no longer a dipole antenna and functions as a loop antenna. Under the conditions currently assumed in this embodiment, the impedance of the antenna after the impedance adjustment is done by the inductor should be placed in the first quadrant (I) of the Smith chart as shown in FIG. 5.

Figure 5:
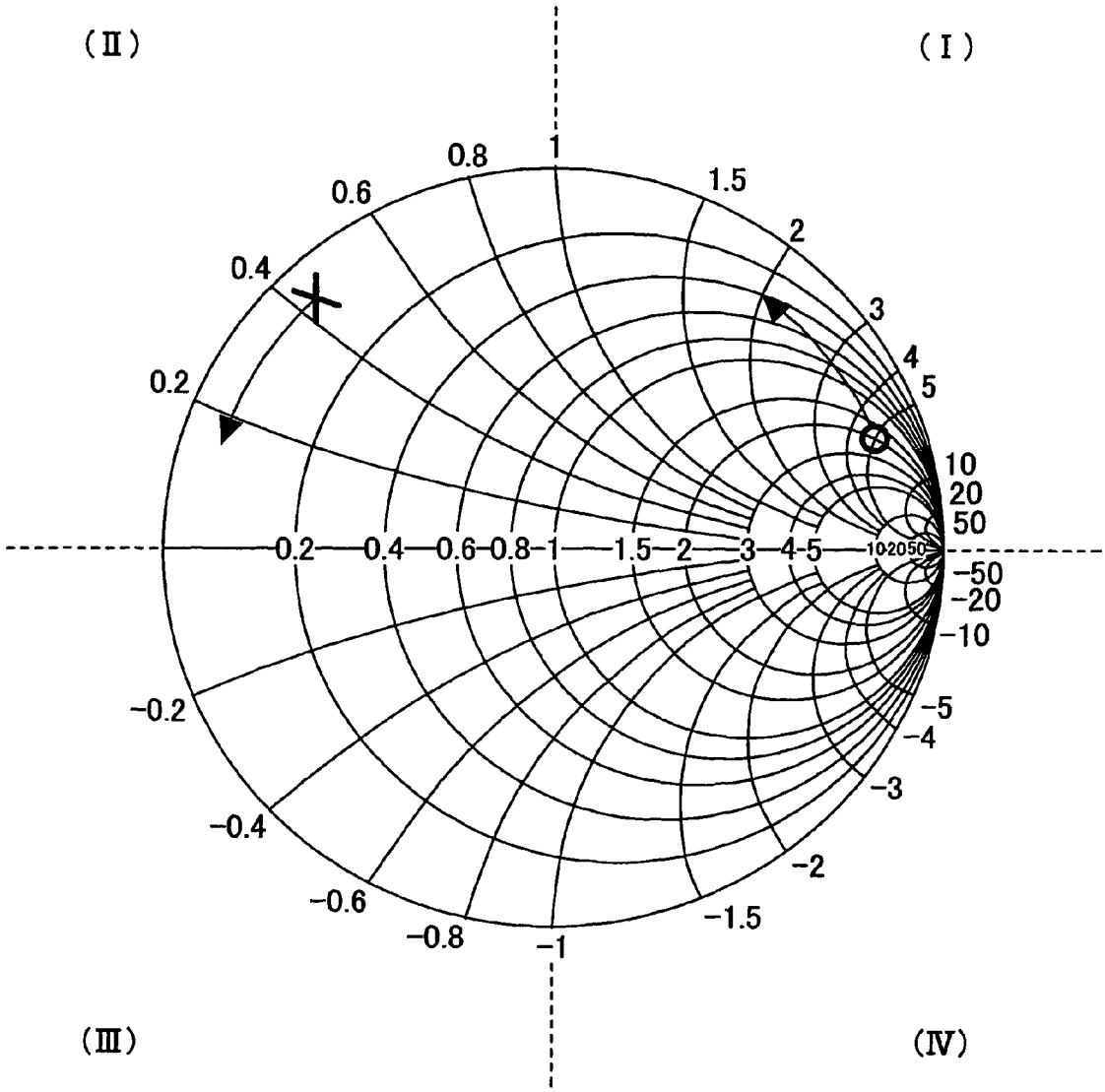
FIG. 5 is a diagram for explaining the characteristics of a dipole antenna and a loop antenna.

In FIG. 5, the white circle denotes the impedance of the dipole antenna before impedance adjustment ($W<2(L+T)$). If the inductance is changed by changing the position of the branch point C on the line element, then the impedance is changed as indicated by the arrow extending from the white circle in FIG. 5.

On the other hand, the impedance of a loop antenna is placed in the second quadrant (II) of the Smith chart. In FIG. 5, the X mark denotes a corresponding impedance of the loop antenna. In the case of the loop antenna, even if the inductance is changed by adjusting the position of the branch point C, the impedance is changed as indicated by the arrow extending from the X mark in FIG. 5. For this reason, it is difficult to place the impedance in the first quadrant of the Smith chart in the case of a loop antenna.

FIG. 6A through FIG. 6D are diagrams for explaining a method of producing an RF tag in an embodiment of the invention. Each of FIG. 6A, FIG. 6B and FIG. 6C includes a plan view and a side view of the RF tag, and FIG. 6D includes only a side view of the RF tag.

Figure 6A:
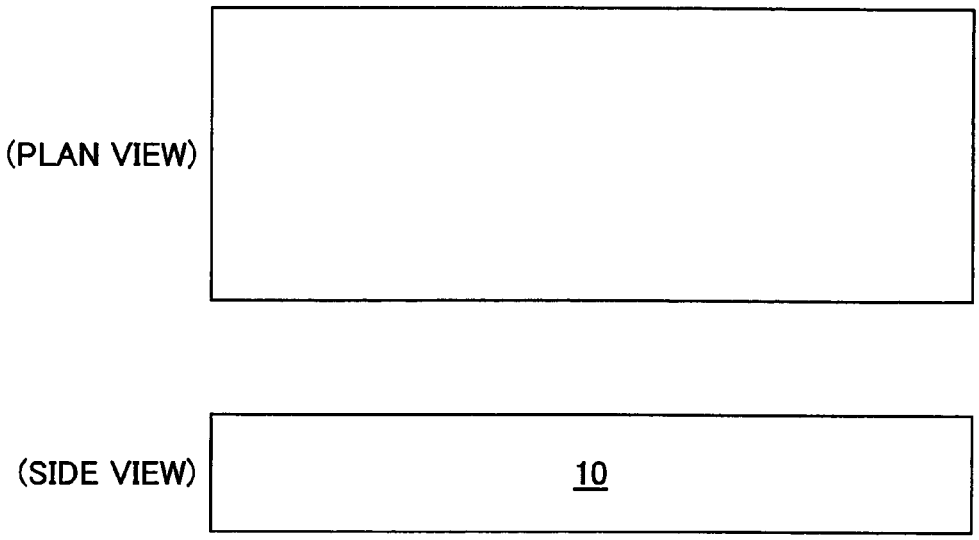
FIG. 6A is a diagram for explaining a method of producing an RF tag in an embodiment of the invention.

In the step shown in FIG. 6A, a spacer 10 with predetermined physical properties is arranged. For example, the spacer 10 has a relative permittivity of 2.6 and a dielectric loss (tan δ) of 0.008.

Figure 6B:
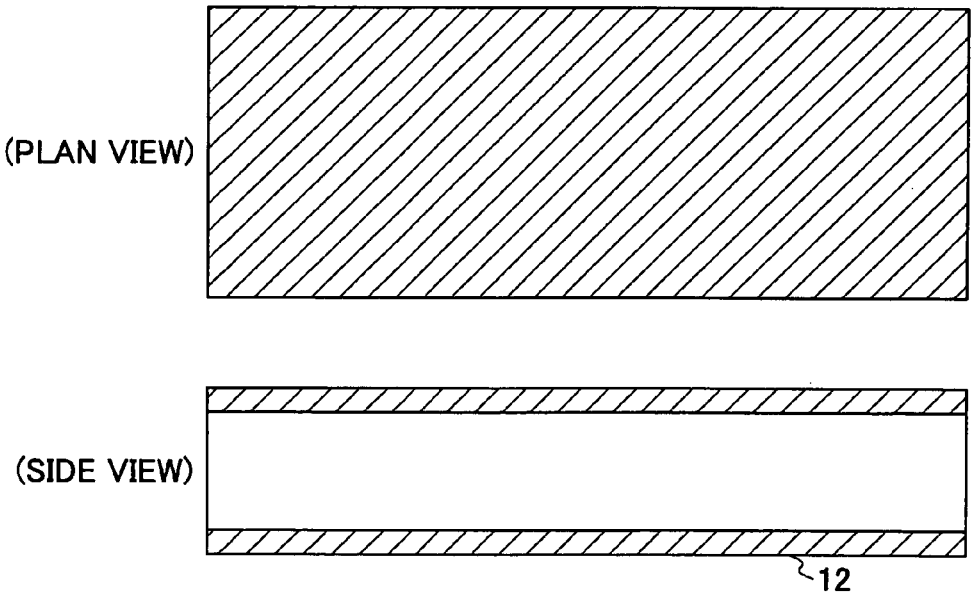
FIG. 6B is a diagram for explaining the method of producing the RF tag in this embodiment.

In the step shown in FIG. 6B, a conductive layer is formed all over the top and bottom surfaces of the spacer 10 using the known metal film deposition technology, such as vapor deposition. For example, the conductive layer has a conductivity of $5\times10^6$ S/m.

Figure 6C:
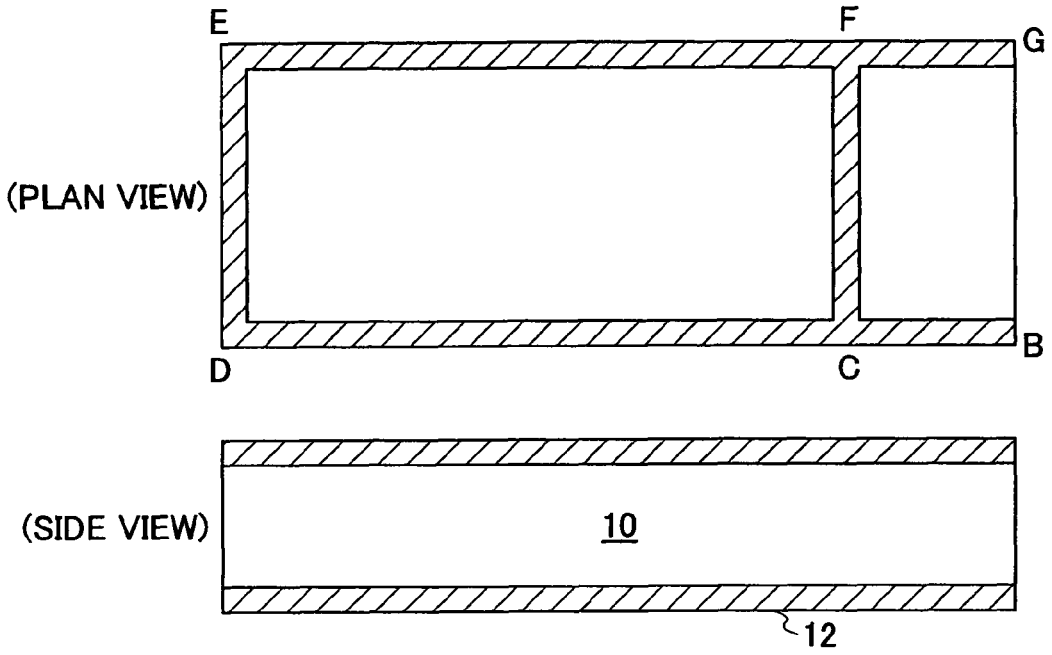
FIG. 6C is a diagram for explaining the method of producing the RF tag in this embodiment.

In the step shown in FIG. 6C, a patterning of the conductive layer on the top surface of the spacer 10 is performed using the known patterning technology, such as photolithography. By this patterning, most of the transmission lines as shown in FIG. 1 and FIG. 2 (all the line elements other than the line element AB and the line element GH) are formed. The transmission lines may be formed by microstrip lines.

Figure 6D:
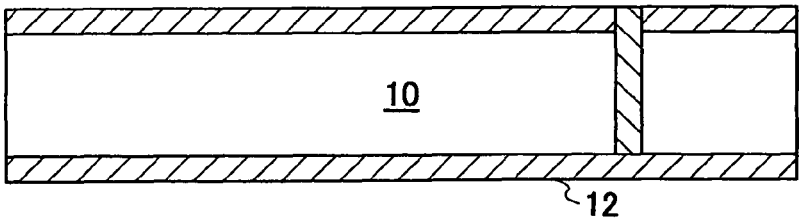
FIG. 6D is a diagram for explaining the method of producing the RF tag in this embodiment.

In the step shown in FIG. 6D, a through hole which penetrates the spacer 10 from the transmission line in a vicinity of the point B and reaches the conductive layer on the bottom surface is formed. Similarly, a through hole which penetrates the spacer 10 from the transmission line in a vicinity of the point G and reaches the conductive layer on the bottom surface is also formed. These through holes are filled up with a conductive material, and the transmission line on the top surface of the spacer and the grounding conductor on the bottom surface of the spacer are electrically connected together by the through holes.

For the sake of convenience of description, a step of arranging a power supply circuit has been omitted. A power supply circuit may be arranged on the line element BC at a suitable stage subsequently after the step of FIG. 6C is performed.

For the sake of convenience of description, the conductive layer for the transmission lines on the top surface of the spacer and the conductive layer for the grounding conductor on the bottom surface of the spacer are formed simultaneously. Alternatively, the conductive layer for the transmission lines on the top surface of the spacer and the conductive layer for the grounding conductor on the bottom surface of the spacer may be formed separately, and they may be formed using different source materials.

Figure 7A:
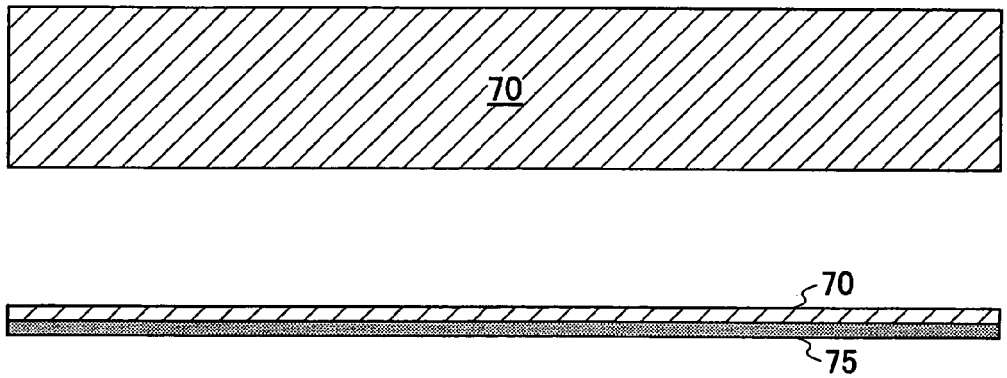
FIG. 7A is a diagram for explaining a method of producing an RF tag in another embodiment of the invention.
Figure 7B:
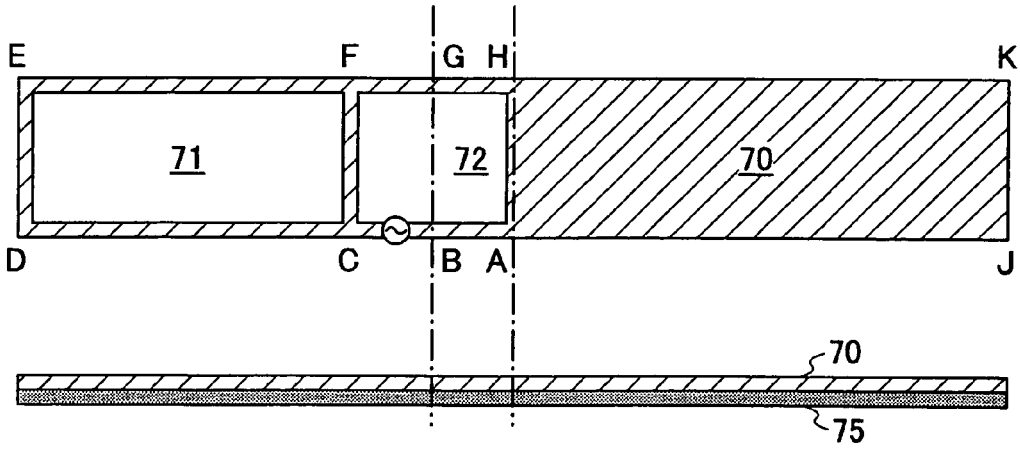
FIG. 7B is a diagram for explaining the method of producing the RF tag in this embodiment.
Figure 7C:
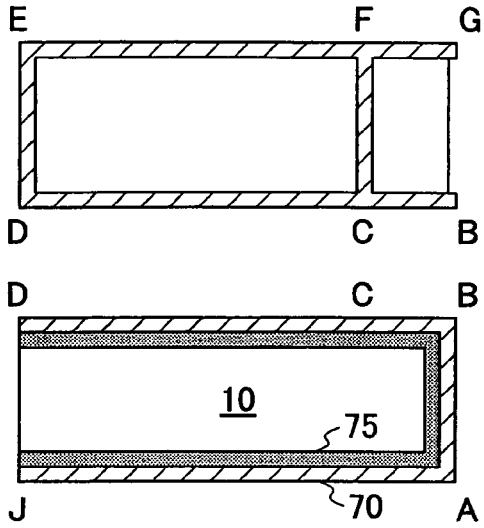
FIG. 7C is a diagram for explaining the method of producing the RF tag in this embodiment.

Next, a description will be given of another embodiment of the invention. FIG. 7A, FIG. 7B and FIG. 7C are diagrams for explaining a method of producing an RF tag in another embodiment of the invention.

In the step shown in FIG. 7A, a conductive layer 70 which is extending in a belt-like manner is formed on a flexible film 75. For example, a polyethylene-terephthalate (PET) film is used for the flexible film 75 in this embodiment. Alternatively, any other flexible film which can be suitably used to support the conductive layer 70 may be used instead.

It should be noted that the thickness of each of the layers or films shown in FIGS. 7A-7C as well as FIGS. 6A-6D is enlarged from the actual dimension for the purpose of illustration. The above-mentioned film formation may be performed using the known film deposition method. The film deposition method, such as vapor deposition, may be used. Alternatively, a printing technique using a printer, etc. may also be used.

In the step shown in FIG. 7B, two windows 71 and 72 which penetrate the conductive layer 70 and the PET film 75 are formed. Subsequently, the window frames surrounding these windows will constitute conductive transmission lines. In this embodiment, after forming the conductive layer on the PET film, the two windows are formed. Alternatively, a conductive layer in which two windows are beforehand formed may be formed on the PET film 75 in the step shown in FIG. 7A.

In the step shown in FIG. 7C, the conductive layer 70 and the PET film 75 are stuck on the top surface, the front surface, and the bottom surface of the spacer 10. In this case, the conductive layer 70 and the PET film 75 are bent 90 degrees at two places indicated by the dotted line in FIG. 7B. In this manner, a conductive layer may be formed without using the spacer 10 as the base for the film formation.

According to this embodiment, it is possible to not only manufacture an RF tag simply, but also extend the flexibility to change the manufacturing process. For example, the component supplier who supplies conductive antennas, and the component supplier who supplies spacers may be the same, or they may be different. Moreover, according to this embodiment, the processing of antennas and the processing of spacers may be performed in parallel, and this is desirable from the viewpoint of increasing the throughput.

Figure 8:
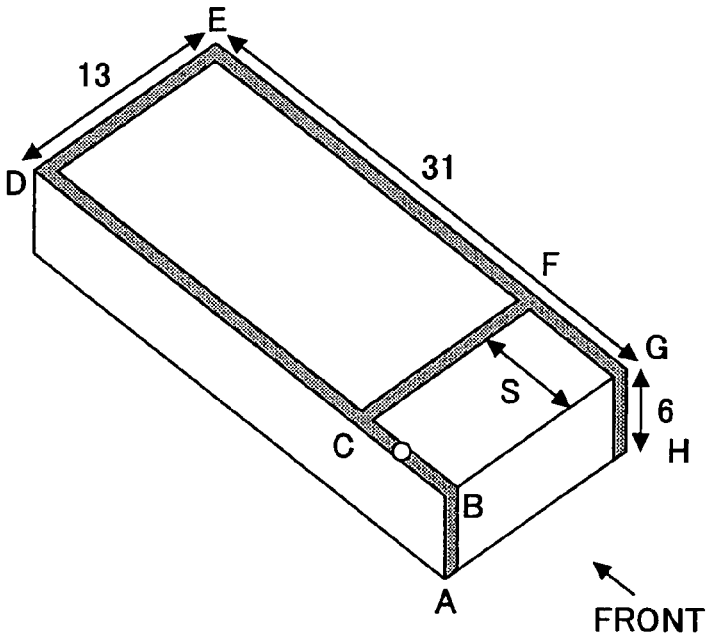
FIG. 8 is a perspective view of an example of an RF tag for use in simulation tests.

Next, a description will be given of another embodiment of the invention. FIG. 8 is a perspective view of an example of an RF tag for use in simulation tests. The numerical values in FIG. 8 denote a size of the RF tag in millimeters (namely, the width: 13 mm, the length: 31 mm, and the thickness: 6 mm).

The pattern of conductive transmission lines as shown in FIG. 1 may be formed on the top surface and the front surface of the spacer, and the bottom surface of the spacer may be connected to the ideal grounding conductor.

In the simulation tests, chip capacitance Ccp (pF), antenna resistance Rap (Ω), and antenna gain (dBi) were computed with respect to each of various lengths of the line elements BC and GF. It should be noted that the length of the antenna is much smaller than a typical wavelength (about 30 cm) of UHF band.

Figure 9:
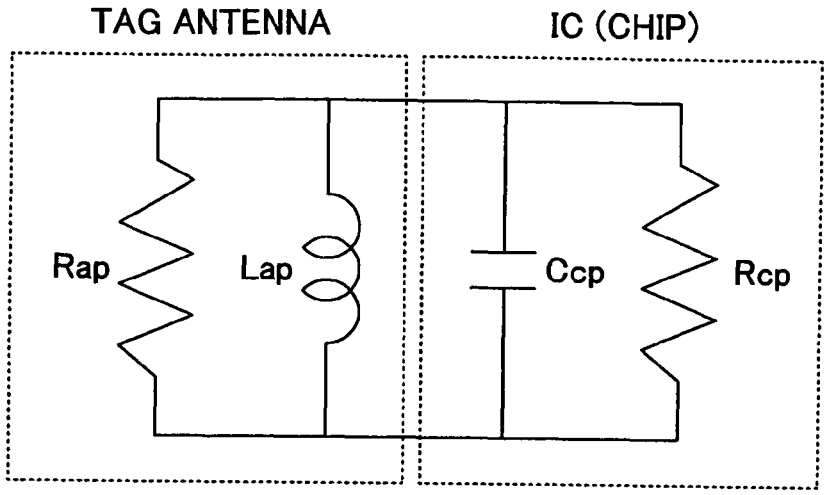
FIG. 9 is a diagram showing the composition of an equivalent circuit of an antenna and an IC chip.

FIG. 9 shows the composition of an equivalent circuit of an antenna and a power supply circuit. As shown in FIG. 9, when an impedance of the antenna matches with an impedance of the power supply circuit (IC chip), both the resistance components are equal to each other and the inductance Lap of the antenna side and the capacitance Ccp of the power supply circuit side satisfy a predetermined condition. Namely, the following formulas are satisfied:

$$Rap=Rcp, \omega Lap=(\omega Ccp)^{-1}$$

where ω denotes an angular frequency.

The line element length S of each of the line element BC and the line element GF in FIG. 8 is changed and the inductance Lap of the antenna is adjusted to satisfy the above-mentioned formulas. Thereby, it is possible to match the impedance of the antenna with the impedance of the power supply circuit.

Figure 10:
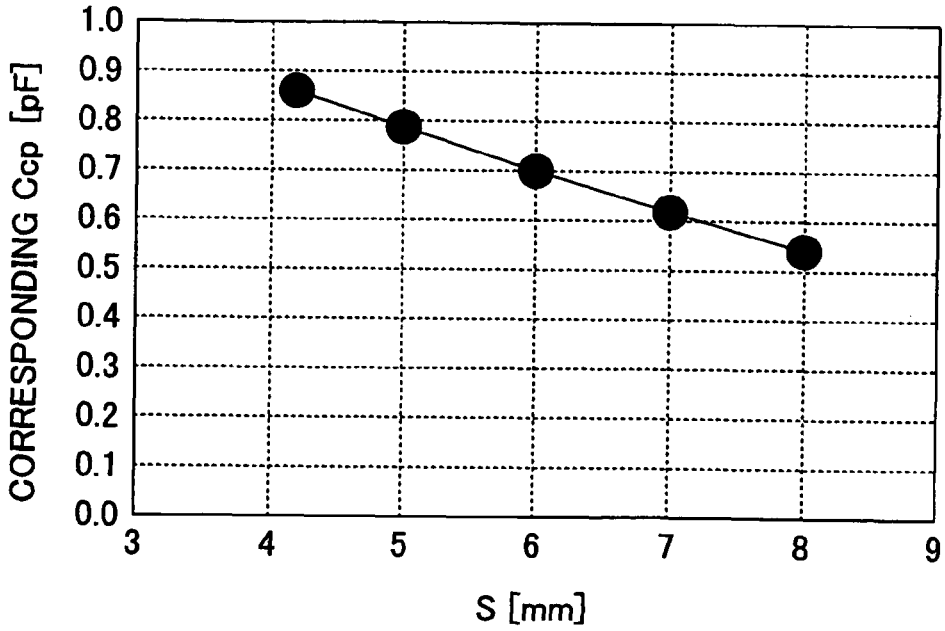
FIG. 10 is a diagram for explaining the results of simulation tests concerning the relationship between line element length and corresponding chip capacitance.

FIG. 10 shows the results of the simulation tests concerning the relationship between line element length S and corresponding chip capacitance Ccp. As is apparent from FIG. 10, it is found out that the chip capacitance Ccp decreases almost linearly from 0.86 pF to 0.54 pF as the line element length S increases from 4.2 mm to 8 mm. For example, if the chip capacitance Ccp for the typical operating frequency of UHF band, such as 950 MHz, is about 0.6 pF, the line element length S in that case should be set to about 7 mm.

Figure 11:
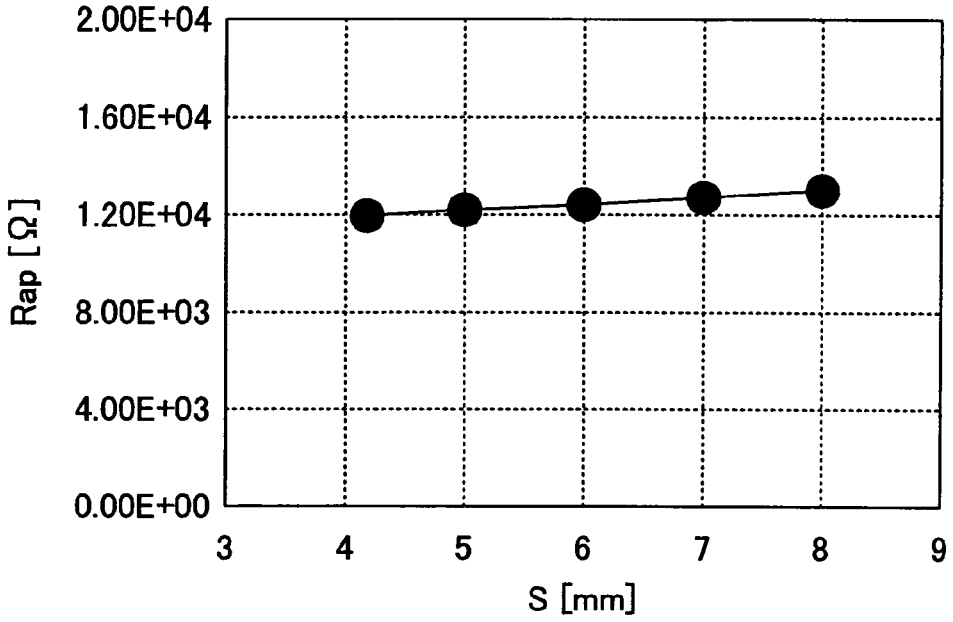
FIG. 11 is a diagram for explaining the results of simulation tests concerning the relationship between line element length and antenna resistance.

FIG. 11 shows the results of the simulation tests concerning the relationship between line element length S and antenna resistance Rap. As is apparent from FIG. 11, it is found out that the antenna resistance Rap gently increases from 11.9 kΩ to 12.9 kΩ almost linearly as the line element length S increases from 4.2 mm to 8 mm. For example, if the line element length S is about 7 mm, the antenna resistance in that case is equal to about 12.7 kΩ.

Figure 12:
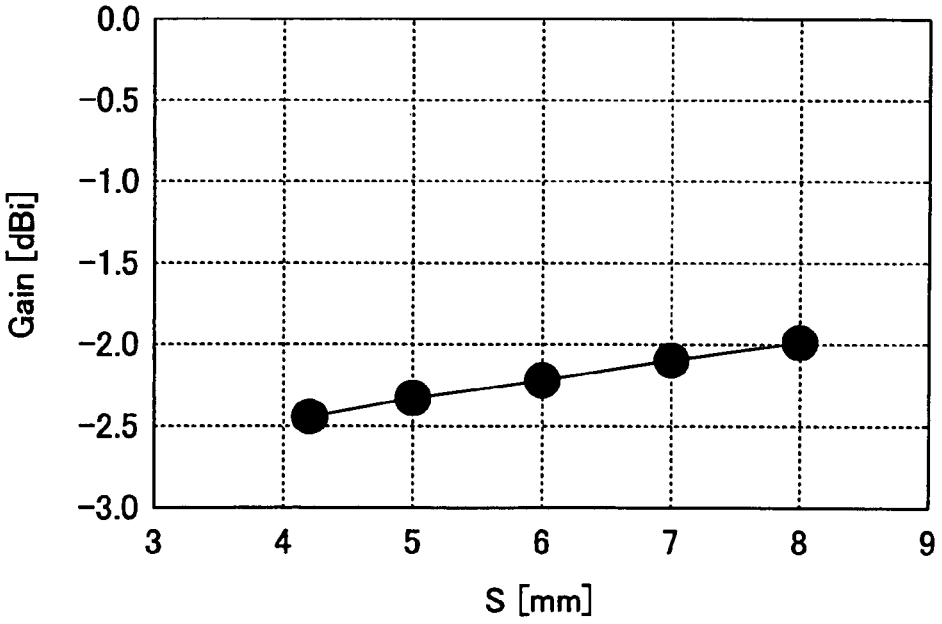
FIG. 12 is a diagram for explaining the results of simulation tests concerning the relationship between line element length and antenna gain.

FIG. 12 shows the results of the simulation tests concerning the relationship between line element length S and antenna gain. As is apparent from FIG. 12, it is found out that the antenna gain increases from −2.45 dBi to −1.99 dBi almost linearly as the line element length S increases from 4.2 mm to 8 mm. For example, if the line element length S is about 7 mm, the antenna gain in that case is equal to about −2.1 dBi.

Among the elements (Rap, Lap, gain) which determine the impedance to be matched, the inductance Lap (the capacitance Ccp) is determined for the first time. This is because the inductance is the most important for the matching of impedance. The antenna gain is also important. However, if the antenna gain is high but in a mismatching state with the power supply circuit, then obtaining the benefit of high gain is difficult.

Figure 13:
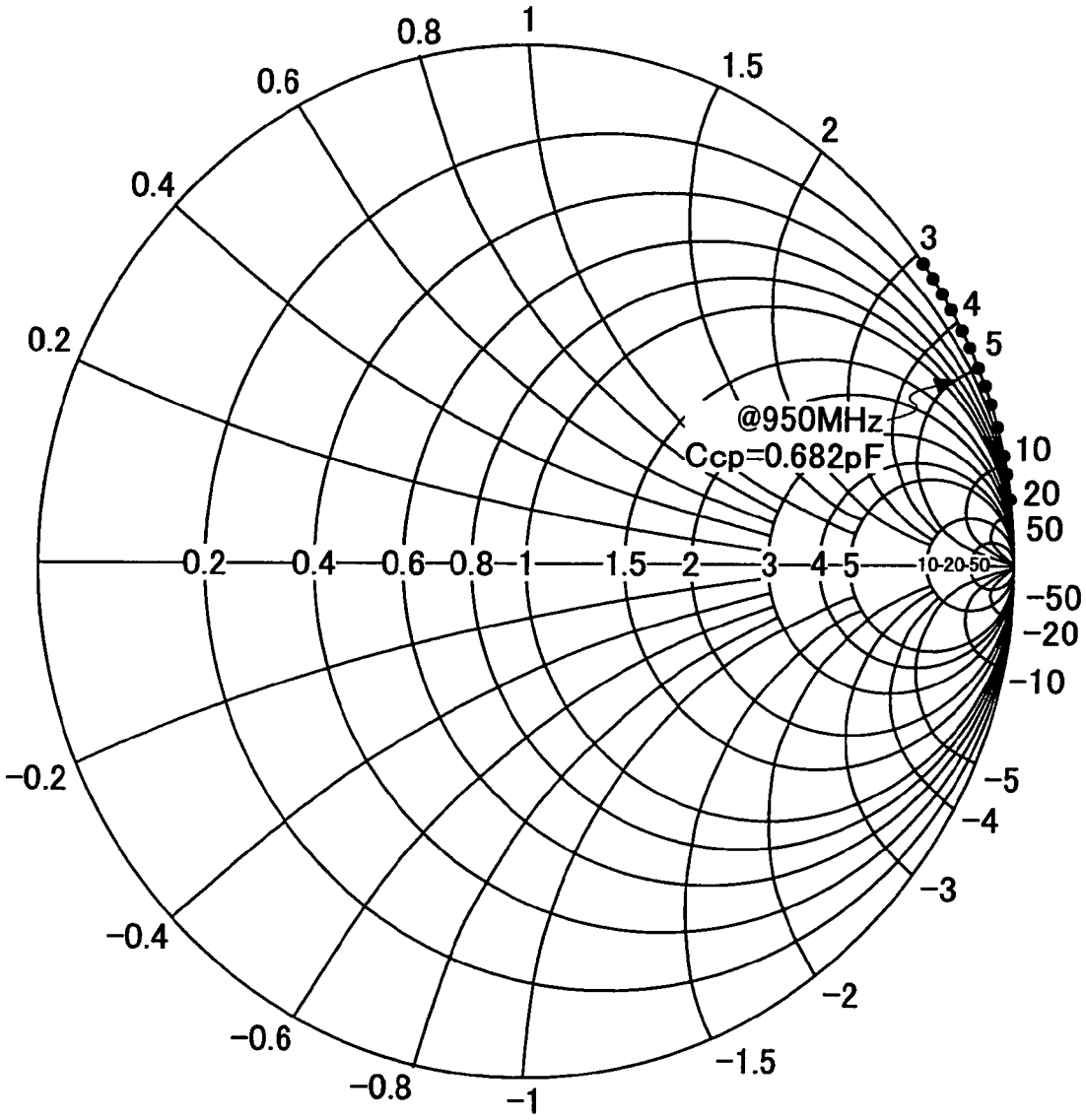
FIG. 13 is a diagram for explaining the frequency characteristic of an RF tag.

FIG. 13 is a diagram for explaining the frequency characteristics of an RF tag as shown in FIG. 8. The values of impedance computed for every 25 MHz from 800 MHz to 1.1 GHz are plotted on the Smith chart. The value of impedance when the chip capacitance is 0.682 pF at 950 MHz is indicated by the arrow in FIG. 13. The line element length S in this case is set to about 6.2 mm. As shown in FIG. 13, the change of impedance is not so large even if the frequency is changed greatly, and this RF tag is applicable also for the wide-band product uses.

Figure 14:
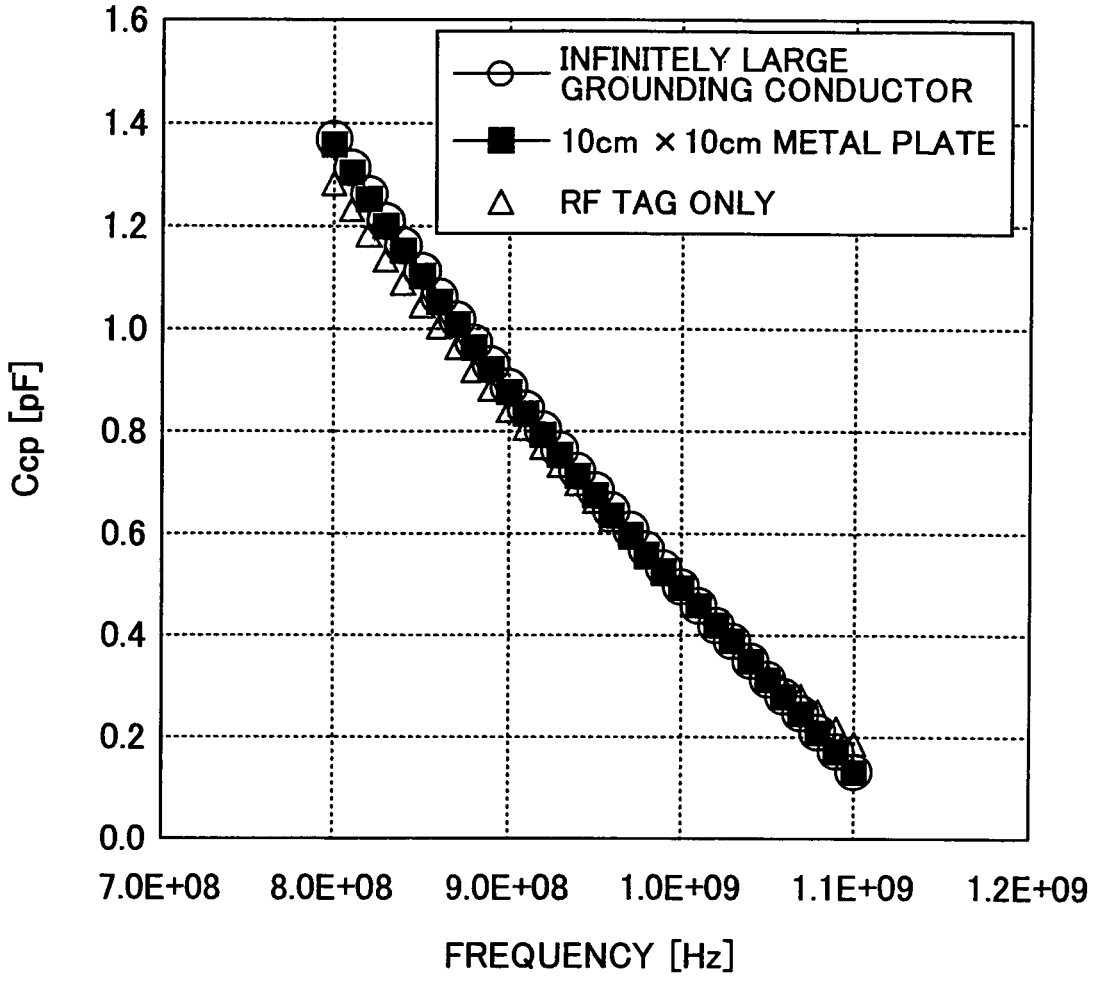
FIG. 14 is a diagram for explaining the results of simulation tests concerning the relationship between frequency and chip capacitance.

FIG. 14 shows the results of simulation tests concerning the relationship between frequency and chip capacitance for each of three grounding methods of an RF tag.

It is assumed for the simulation tests that the three grounding methods are: (1) the bottom surface of the RF tag is connected to the ideal, infinitely large grounding conductor; (2) it is connected with a 10 cm×10 cm metal plate; and (3) it is not connected with any other metal.

As shown in FIG. 14, regardless of whether the grounding method used is any of the three methods, the chip capacitance decreases almost linearly from about 1.3 pF to about 0.7 pF as the frequency increases from 800 MHz to 1.1 GHz. Therefore, it is found out that the use of a specific grounding method does not have great influences on the matching in impedance of the antenna and the power supply circuit. This means that, regardless of whether the object with which the RF tag is accompanied has conductivity or not, matching the impedance of the antenna and the impedance of the power supply circuit in the RF tag is possible. Accordingly, there are a variety of products with which the RF tag of this embodiment can be accompanied.

Figure 15:
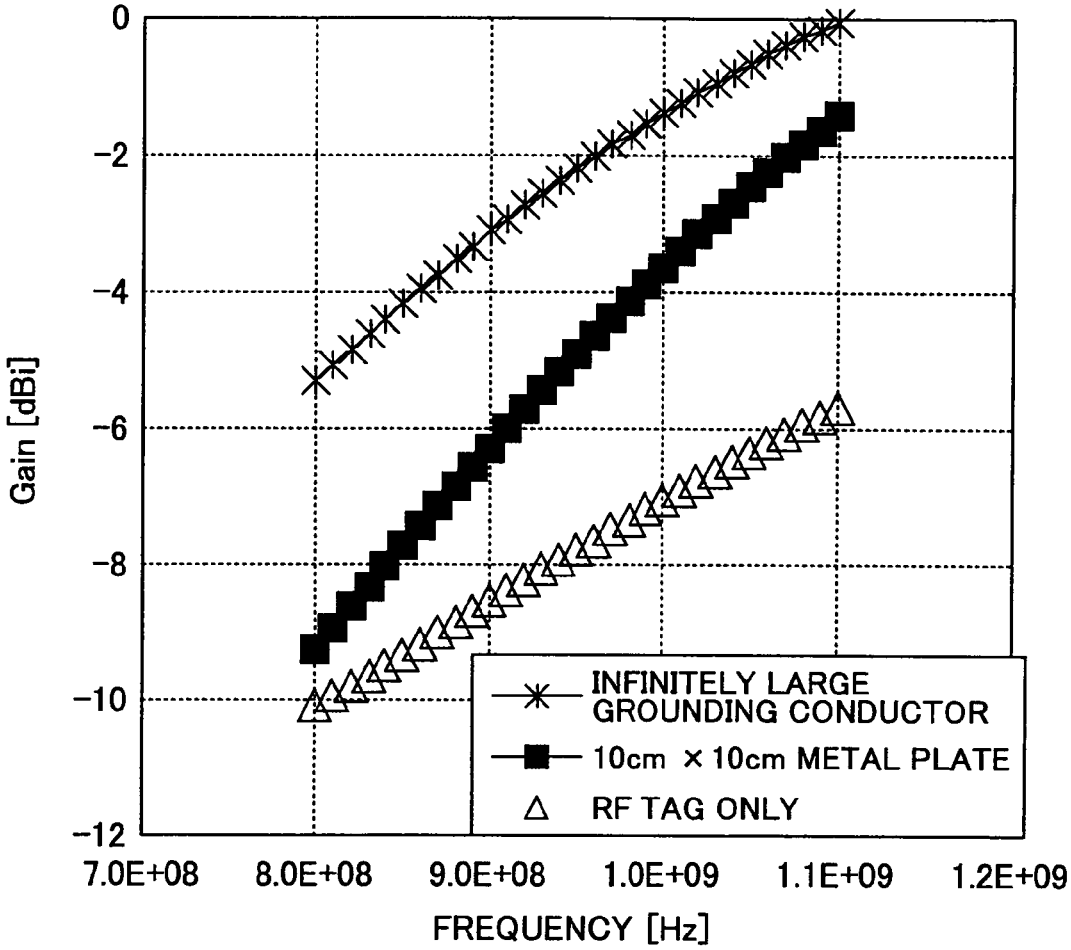
FIG. 15 is a diagram for explaining the results of simulation tests concerning the relationship between frequency and antenna gain.

FIG. 15 shows the results of simulation tests concerning the relationship between frequency and antenna gain with respect to each of the three grounding methods (1), (2) and (3) mentioned above. As is apparent from FIG. 15, with respect to each of the three grounding methods, the gain increases as the frequency increases. However, the way the gain increases varies depending on the grounding method used. Specifically, when the frequency increases from 800 MHz to 1.1 GHz, the gain for the grounding method (1) increases from about −5.5 dBi to 0 dBi, the gain for the grounding method (2) increases from −9.5 dBi to −1.5 dBi, and the gain for the grounding method (3) increases from −10.2 dBi to −6.2 dBi. It is found out from the simulation results that, from the viewpoint of increasing the antenna gain, a grounding method which gives the grounding potential to the RF tag more stably would be advantageous.

Moreover, according to the simulation results of FIG. 14, the use of a specific grounding method does not have great influences on the matching in impedance of the antenna and the power supply circuit, and it is desirable that the RF tag is connected to the grounding potential which is stabilized as much as possible.

Figure 16:
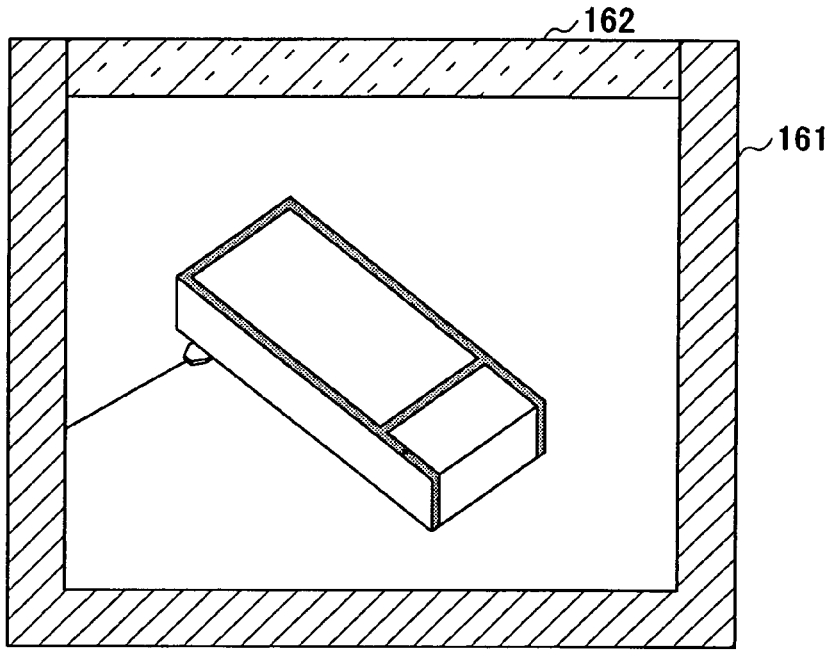
FIG. 16 is a diagram showing an example in which an RF tag is accommodated in a housing having a metal surface.

From the above-mentioned viewpoint, when an object with which an RF tag is accompanied has a metal housing, it is desirable that the RF tag is accommodated in the metal housing and the RF tag is connected to the metal housing, as shown in FIG. 16.

In the example shown in FIG. 16, an RF tag is accommodated in a housing which includes a metal surface 161 and an insulating material surface 162, and a grounding conductor on a bottom surface of the RF tag is connected to the metal surface 161. The insulating material surface 162 may be made of a resin material.

Next, a description will be given of another embodiment of the invention. FIG. 17A through FIG. 17H show various modifications of an antenna, an inductor, a power supply circuit, a grounding conductor, etc. of an RF tag.

Figure 17A:
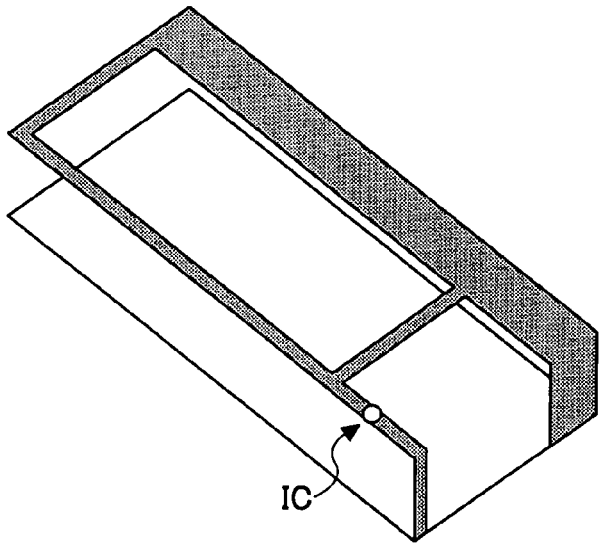
FIG. 17A is a diagram showing an RF tag in which transmission lines of different line widths are arranged.
Figure 17B:
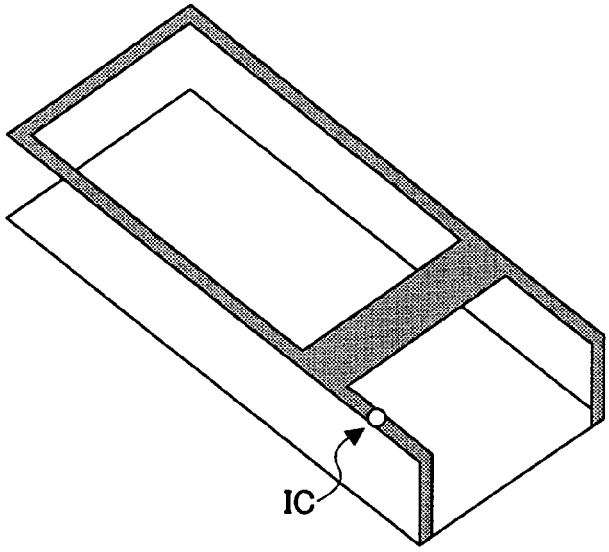
FIG. 17B is a diagram showing an RF tag in which transmission lines of different line widths are arranged.
Figure 17C:
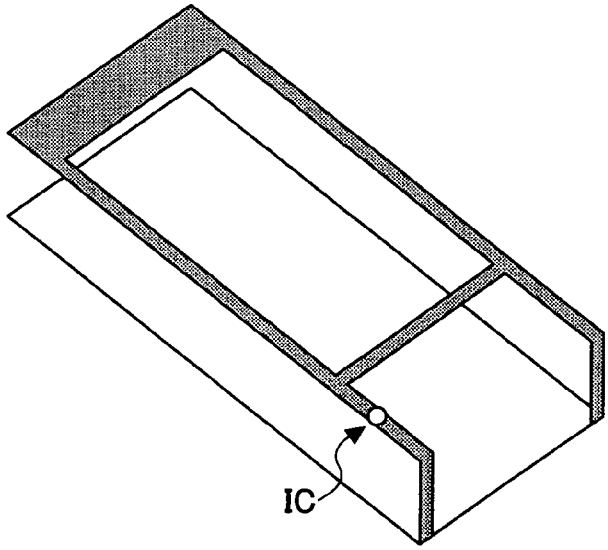
FIG. 17C is a diagram showing an RF tag in which transmission lines of different line widths are arranged.

In the above-mentioned embodiments, the conductive transmission lines which constitute the antenna and the inductor are formed so that all of the conductive transmission lines have equal line width. Alternatively, as shown in FIG. 17A, FIG. 17B and FIG. 17C, the conductive transmission lines may be formed so that some of the conductive transmission lines have a different line width.

From the viewpoint of avoiding defective matters, such as disconnection, it is desirable to make the line width as large as possible. From the viewpoint of saving the conductive material, it is desirable to make the line width as small as possible.

Figure 17D:
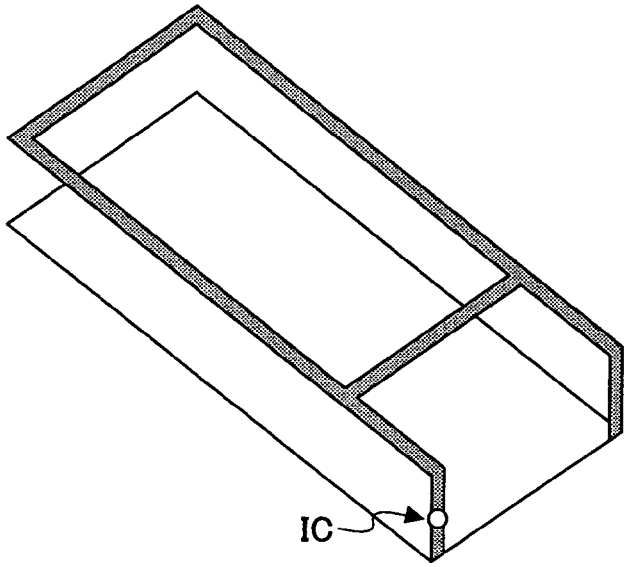
FIG. 17D is a diagram showing an RF tag in which a power supply circuit is arranged at a different position.

The power supply circuit (IC) may be disposed on the top surface of an RF tag. Alternatively, as shown in FIG. 17D, the power supply circuit (IC) may be disposed on the front surface of an RF tag. However, the thickness T of the spacer is comparatively small and the length L of the spacer is comparatively large, and it is desirable to dispose an IC on the top surface of an RF tag, from the viewpoint of facilitating the IC loading process.

Figure 17E:
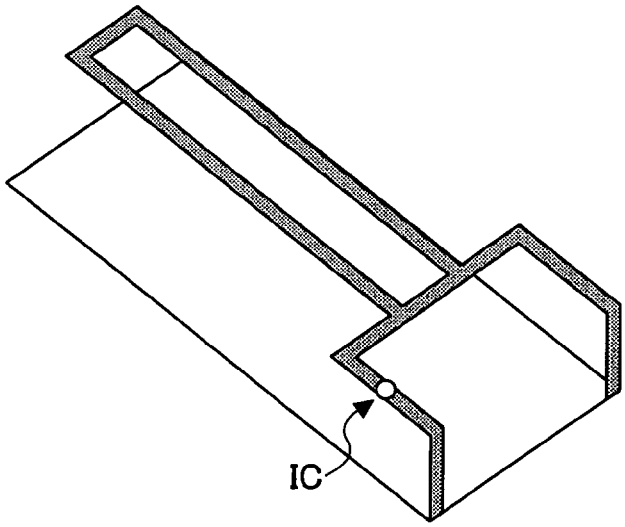
FIG. 17E is a diagram showing an RF tag in which transmission lines of different spacing are arranged.
Figure 17F:
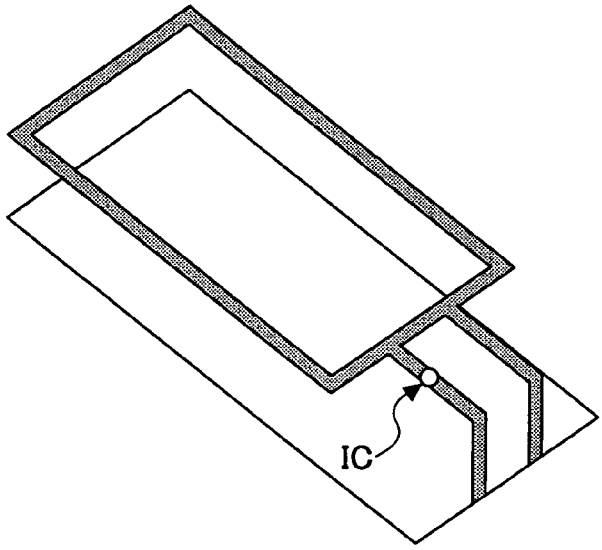
FIG. 17F is a diagram showing an RF tag in which transmission lines of different spacing are arranged.

The conductive transmission lines may be arranged to have a form along the sides of the spacer in the shape of a rectangular parallelepiped. Alternatively, as shown in FIG. 17E and FIG. 17F, some of the conductive transmission lines may be formed on the top surface or the front surface of the spacer. The spacing of parallel transmission lines at a certain place may be different from that at other places. However, it is desirable to reduce the number of times of bending of a transmission line, from the viewpoint of reducing undesired influences (reflection, etc.) on a transmission signal flowing through the transmission line.

Figure 17G:
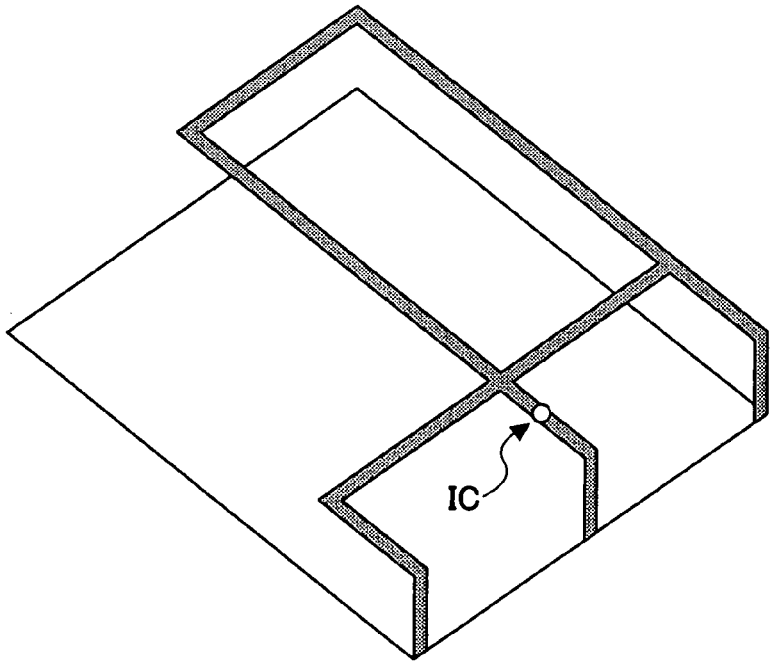
FIG. 17G is a diagram showing an RF tag in which transmission lines of an inductor are arranged independently with those of an antenna.
Figure 17H:
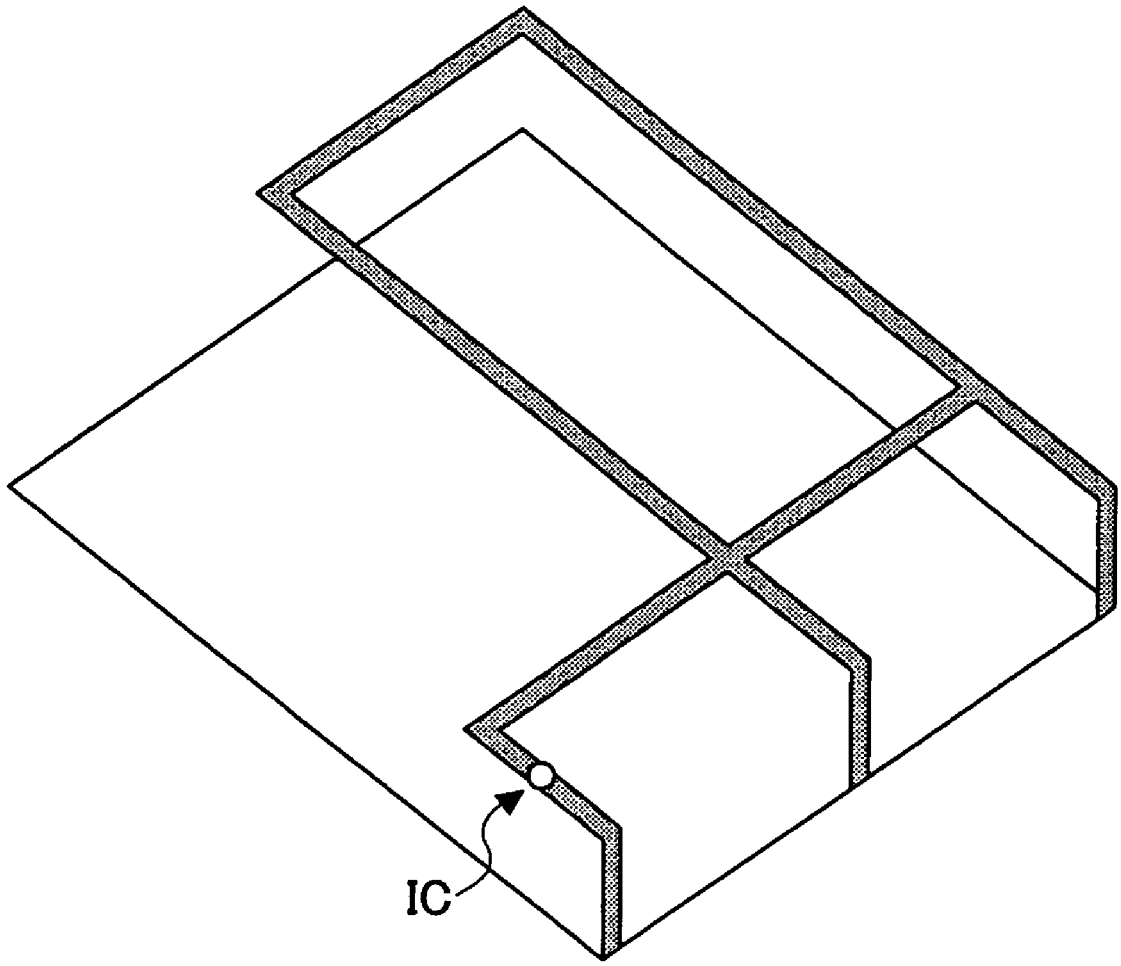
FIG. 17H is a diagram showing an RF tag in which transmission lines of an inductor are arranged independently with those of an antenna.

The transmission lines which constitute a dipole antenna and the transmission lines which constitute an inductor may be partially shared. Alternatively, as shown in FIG. 17G and FIG. 17H, the transmission lines which constitute an inductor may be provided separately from the transmission lines which constitute a dipole antenna. However, it is necessary that the transmission lines of the inductor are formed appropriately so that a conductor exists under the transmission lines of the inductor so as to allow an image current to flow therethrough.

The present invention is not limited to the specifically disclosed embodiments, and variations and modifications may be made without departing from the scope of the present invention.

What is claimed is:

1. An RF tag comprising:

a grounding conductor;

a spacer of a material having a predetermined dielectric constant;

a first transmission line connected to the grounding conductor and forming an electric closed loop to constitute a dipole antenna;

a power supply circuit connected in series to the first transmission line and arranged between a first branch point on the first transmission line and the grounding conductor; and a second transmission line connected between the first branch point and a second branch point on the first transmission line and arranged in parallel with the power supply circuit to constitute an inductor, wherein the first and second transmission lines are arranged on the spacer to have a form along sides of a rectangular parallelepiped, and the grounding conductor is arranged on a bottom surface of the spacer and the first and second transmission lines are arranged on top and front surfaces of the spacer.

2. The RF tag according to claim 1, wherein the first and second transmission lines are arranged so that an image current flowing through the first and second transmission lines flows through the grounding conductor.

3. The RF tag according to claim 1, wherein the first transmission line includes a first pair of parallel transmission line elements connected to the grounding conductor, and the second transmission line includes a second pair of parallel transmission line elements perpendicularly intersecting the first pair of parallel transmission line elements.

4. The RF tag according to claim 1, wherein a line element length of a second pair of transmission line elements included in the second transmission line is smaller than twice a line element length of a first pair of transmission line elements included in the first transmission line.

5. The RF tag according to claim 1, wherein a position of the first branch point on the first transmission line is adjusted so that an impedance of the dipole antenna matches with an impedance of the power supply circuit.

6. The RF tag according to claim 1, further comprising a housing with which the RF tag is accompanied, wherein the grounding conductor is connected to a metal surface of the housing.

7. The RF tag according to claim 1, wherein the first and second transmission lines are formed by microstrip lines.

8. A method of producing an RF tag in which a first transmission line forming an electric closed loop to constitute a dipole antenna and a second transmission line constituting an inductor are formed on a spacer of a material having a predetermined dielectric constant, and a grounding conductor is electrically connected to the first and second transmission lines, the method comprising:

arranging a power supply circuit, which is connected in series to the first transmission line, between a first branch point on the first transmission line and the grounding conductor; and arranging the second transmission line which is connected between the first branch point and a second branch point on the first transmission line so that the second transmission line is arranged in parallel with the power supply circuit, wherein the grounding conductor is arranged on a bottom surface of the spacer, and the first and second transmission lines are arranged on front and top surfaces of the spacer and arranged to have a form along sides of a rectangular parallelepiped.

* * * * *